US010315120B2

(12) United States Patent
McVeen et al.

(10) Patent No.: US 10,315,120 B2
(45) Date of Patent: Jun. 11, 2019

(54) BOOM COASTER

(71) Applicant: Universal City Studios LLC, Universal City, CA (US)

(72) Inventors: Keith Michael McVeen, Orlando, FL (US); Eric Parr, Orlando, FL (US); Thierry Coup, Orlando, FL (US); Eric A. Vance, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 368 days.

(21) Appl. No.: 15/085,898

(22) Filed: Mar. 30, 2016

(65) Prior Publication Data

US 2016/0288000 A1 Oct. 6, 2016

Related U.S. Application Data

(60) Provisional application No. 62/141,044, filed on Mar. 31, 2015, provisional application No. 62/171,682, filed on Jun. 5, 2015.

(51) Int. Cl.
*A63G 21/12* (2006.01)
*A63G 7/00* (2006.01)

(52) U.S. Cl.
CPC ..... *A63G 21/12* (2013.01); *A63G 7/00* (2013.01)

(58) Field of Classification Search
CPC ..... A63G 7/00; A63G 21/08; A63G 25/00; A63G 21/04; A63G 1/30; A63G 1/24; A63G 1/34; A63G 21/12; B61B 3/00; B61B 5/00
USPC ..... 104/53, 54, 55, 56, 57, 60, 61, 63, 64, 104/73, 74, 75, 76, 82, 83, 84, 85
See application file for complete search history.

(56) References Cited

U.S. PATENT DOCUMENTS 5,967,051 A * 10/1999 Ragsdale ..... B61K 7/08 104/250
6,269,749 B1 8/2001 Hogg
6,269,750 B1 8/2001 Cornwell et al.
7,354,351 B2 4/2008 Edwards
7,594,473 B2 9/2009 Kitchen et al.
7,836,829 B2 11/2010 Burger
8,065,963 B2 11/2011 Groels
8,066,576 B2 11/2011 Threlkel
(Continued)

FOREIGN PATENT DOCUMENTS

GB 331577 7/1930

OTHER PUBLICATIONS

PCT/US2016/025280 International Search Report and Written Opinion dated Jun. 13, 2016.
CN 201680031886.3 Office Action dated Jan. 30, 2019.

*Primary Examiner* — Mark T Le
(74) *Attorney, Agent, or Firm* — Fletcher Yoder, P.C.

(57) ABSTRACT

A boom coaster includes a passenger vehicle, a track, a bogie coupled to the passenger vehicle and the track and configured to move along the track, and a simulated ride surface positioned above the track and beneath the passenger vehicle. The simulated ride surface is configured to imitate a path of the passenger vehicle, the bogie is coupled to a surface of the passenger vehicle via a leg member extending around the simulated ride surface, and the leg member suspends the passenger vehicle above the simulated surface such that the bogie and the track are blocked from a passenger view perspective of the passenger vehicle.

13 Claims, 12 Drawing Sheets

(56) References Cited

U.S. PATENT DOCUMENTS

| | | | | |
|---|---|---|---|---|
| 8,132,513 | B2 | 3/2012 | Crawford et al. | |
| 8,360,893 | B2 * | 1/2013 | Howard | A63G 21/08 104/53 |
| 8,393,275 | B2 | 3/2013 | Jacobi et al. | |
| 8,453,578 | B2 | 6/2013 | Beutler | |
| 9,272,224 | B2 | 3/2016 | Nemeth et al. | |
| 2008/0173208 | A1 * | 7/2008 | Heinrich | A63G 7/00 104/75 |

* cited by examiner

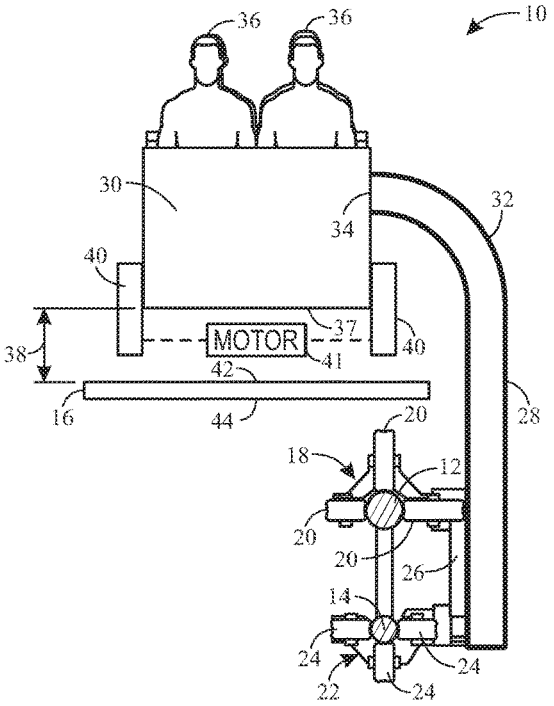
13 *FIG. 1*
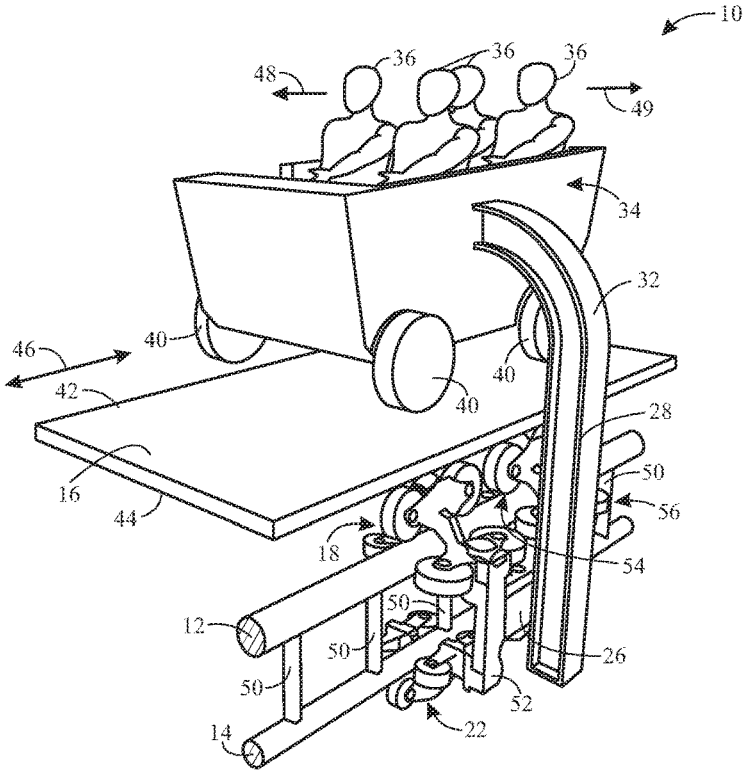
*FIG. 2*

BOOM COASTER

CROSS REFERENCE TO RELATED APPLICATIONS

This application claims the benefit of U.S. Provisional Application No. 62/141,044, entitled "CANTILEVERED COASTER," filed Mar. 31, 2015, and U.S. Provisional Application No. 62/171,682, entitled "CANTILEVERED COASTER," filed Jun. 5, 2015, which are hereby incorporated by reference in their entirety.

FIELD OF DISCLOSURE

The present disclosure relates generally to the field of amusement parks. More specifically, embodiments of the present disclosure relate to systems and methods utilized to provide amusement park experiences.

BACKGROUND

Various amusement rides have been created to provide passengers with unique motion and visual experiences. For example, roller coasters and theme rides can be implemented with multi-passenger vehicles that travel along a fixed path. In addition to the excitement created by the speed or change in direction of the vehicles as they move along the path, the vehicles themselves may generate special effects (e.g., sound and/or motion effects). Although a repeat rider may be familiar with the general path of the ride, the special effects may create interest during second and subsequent rides. In another example, certain rides may be implemented with projection elements to create varying scenery and movement as the passenger vehicles travel along the path. However, regardless of the enhancements to such passenger vehicle rides, the rider in the passenger vehicle may not feel immersed in the ride. For example, the rider generally is aware of being within a ride because of the presence of a ride surface (e.g., a track) as well as being aware of the confines of the vehicle itself. Such awareness of the ride may prevent the ride experience from being a more accurate simulation. Accordingly, there is a need for an improved amusement ride that simulates certain experiences.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In accordance with one embodiment, a boom coaster includes a passenger vehicle, a track, a bogie coupled to the passenger vehicle and the track and configured to move along the track, and a simulated ride surface positioned above the track and beneath the passenger vehicle. The simulated ride surface is configured to imitate a path of the passenger vehicle, the bogie is coupled to a surface of the passenger vehicle via a leg member extending around the simulated ride surface, and the leg member suspends the passenger vehicle above the simulated surface such that the bogie and the track are blocked from a passenger view perspective of the passenger vehicle.

In accordance with another embodiment, a boom coaster includes a passenger vehicle, a track, a bogie coupled to the passenger vehicle and the track and configured to move along the track, a simulated ride surface extending along a ride path defined by the track such that the simulated ride surface remains between the passenger vehicle and the track as the passenger vehicle moves along all or portions of the ride path, and a leg member extending around the simulated ride surface and coupling the bogie to the passenger vehicle to enable the passenger vehicle to move along the ride path.

In accordance with another embodiment, a boom coaster includes a passenger vehicle, a first track disposed below the passenger vehicle, a first bogie coupled to the first track and configured to move along the first track, a second track disposed below the passenger vehicle, a second bogie coupled to the second track and configured to move along the second track, a carrier coupled to the first bogie and the second bogie, where the carrier is configured to be directed along a ride path defined by the first and second tracks by the first bogie and the second bogie, a simulated ride surface extending along the ride path such that the simulated ride surface remains between the passenger vehicle and the first and second tracks as the passenger vehicle moves along portions of the ride path, and a leg member coupled to the carrier and the passenger vehicle, where the leg member is configured to extend around the simulated ride surface and couple to a surface of the passenger vehicle.

DRAWINGS

These and other features, aspects, and advantages of the present disclosure will become better understood when the following detailed description is read with reference to the accompanying drawings in which like characters represent like parts throughout the drawings, wherein:

FIG. 1 is a sectional view of an embodiment of a boom coaster having a passenger vehicle driven by a bogie attached to the passenger vehicle by a leg member or boom, in accordance with an aspect of the present disclosure;

FIG. 2 is perspective view of the boom coaster of FIG. 1, in accordance with an aspect of the present disclosure;

Figure 20:
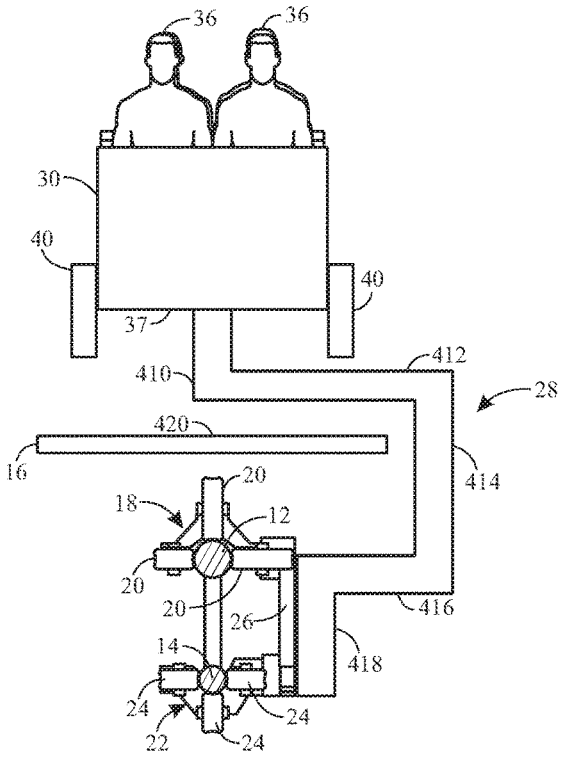
Figure 21:
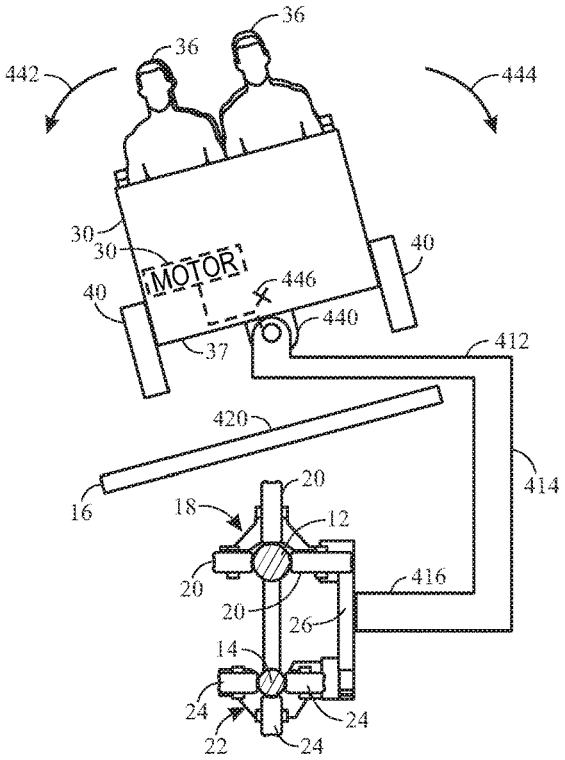

FIG. 20 is a sectional view of an embodiment of the boom coaster of FIG. 1, in which the leg member or boom is coupled to the passenger vehicle at a surface of the passenger vehicle facing a simulated ride surface, in accordance with an aspect of the present disclosure; and FIG. 21 is a section view of an embodiment of the boom coaster of FIG. 1, in which a pivot joint couples the leg member to the passenger vehicle, in accordance with an aspect of the present disclosure.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Present embodiments of the disclosure are directed to an amusement ride that creates a simulation of a vehicle travelling along a simulated ride surface (e.g., faux tracks or a scenic piece that blocks the view of certain system components), while a path of the vehicle actually is directed (e.g., controlled) by a carrier coupled to a track, offset from the simulated ride surface (e.g., hidden from a view of the passenger). Accordingly, the simulated ride surface may include transitions such as varying surfaces, debris, breaks, jumps, or the like, such that the passenger may experience an enhanced sense of thrill due to the impression that the vehicle is safely undergoing such transitions and/or moving across the simulated ride surface. An amusement ride that includes such features may be desirable to enhance the passenger's overall experience and enjoyment. While the present disclosure focuses on an amusement ride that utilizes tracks to direct the carrier and the vehicle along a ride path, it should be noted that embodiments of the present disclosure are suitable for use with any amusement ride (e.g., amusement rides that utilize gravitational forces to direct the vehicle along the ride path rather than power to drive the vehicle).

FIG. 1 is a sectional view of a boom coaster 10 in accordance with aspects of the present disclosure. In certain embodiments, the boom coaster 10 may include an upper track 12 (e.g., with respect to a ground surface 13), a lower track 14 (e.g., with respect to the ground surface 13), and a simulated ride surface 16 (e.g., a scenic surface). As illustrated in FIG. 1, the upper track 12 is positioned above the lower track 14. In other embodiments, the tracks 12 and 14 may be positioned horizontally relative to the ground surface 13 (see FIG. 3) rather than in the vertical configuration (e.g., with respect to the ground surface 13) of FIG. 1. Further, in some embodiments, different track orientations may be used (e.g., the tracks 12, 14 may be positioned above the simulated ride surface 16). In still further embodiments, the boom coaster 10 may include only one track, or the boom coaster 10 may include more than two tracks (e.g., 3, 4, 5, 6, 7, 8, 9, 10, or more).

The upper track 12 may include an upper bogie 18 configured to move along the upper track 12 via one or more wheels 20. Similarly, the lower track 14 may include a lower bogie 22 configured to move along the lower track 14 via one or more wheels 24. As shown in FIG. 1, the bogies 18 and 22 may each include 3 wheels 20, 24. In other embodiments, the bogies 18, 22 may each include one wheel, two wheels, or more than three wheels. The wheels 20, 24 may be pinch wheels or any other device configured to facilitate movement of the bogies 18, 22 along the tracks 12, 14.

In certain embodiments, the upper bogie 18 and the lower bogie 22 may be coupled to a carrier 26 that, in turn, is directed along the upper and lower tracks 12, 14 by the bogies 18 and 22. In other embodiments, the carrier 26 may include the upper bogie 18 and the lower bogie 22. In still further embodiments, the carrier 26, the upper bogie 18, and the lower bogie 22, may be integrated into a single component. An arm or leg member 28 (e.g., a boom) may be coupled to the carrier 26 and to a passenger vehicle 30 (e.g., a vessel that transports one or more passengers along the boom coaster 10). For example, the leg member 28 may be welded to the passenger vehicle 30 and/or the carrier 26, or the leg member 28 may be attached to the passenger vehicle 30 and/or the carrier 26 using any other suitable technique (e.g., via a rotational joint or another type of articulation mechanism as shown in FIG. 21). Further, the leg member 28 may be detachable from the passenger vehicle 30, such that the leg member 28 may be attached to multiple locations of the passenger vehicle 30. In certain embodiments the leg member 28 may be an "I-beam," or a pipe, that includes a curved portion 32 (or angled portion) enabling the leg member 28 to couple to the passenger vehicle 30, while hiding at least portion of the carrier 26 and/or the tracks 12, 14. For example, in the illustrated embodiment, the leg member 28 generally has a J-shape. In other embodiments, the leg member 28 may have an L-shape, a C-shape, an S-shape, or a shape including multiple curves (e.g., a question mark shape). In some embodiments, the leg member 28 (e.g., the boom) may include a single piece of material as opposed to having multiple segments coupled to one another. In other embodiments, the leg member 28 may be any other structural component configured to couple the carrier 26 to the passenger vehicle 30. In still further embodiments, the boom coaster 10 may include more than one leg member 28, as will be discussed in further detail herein with reference to FIGS. 4 and 6.

By coupling the leg member 28 to the passenger vehicle 30 and the carrier 26, the passenger vehicle 30 may move with the bogies 18, 22 along the upper and lower tracks 12, 14. In certain embodiments, the leg member 28 is coupled to a first lateral side 34 of the passenger vehicle 30. Accordingly, the leg member 28 extends around the simulated ride surface 16, thereby eliminating any slot, gap, or groove that would be included in the simulated ride surface 16 if the leg member 28 were coupled to the passenger vehicle 30 in a manner in which the leg member 28 extended through the simulated ride surface 16. It is now recognized that such a configuration may contribute to hiding the tracks 12, 14 from a passenger 36 in the passenger vehicle 30 because the passenger 36 may be blocked from viewing the tracks 12, 14 through the slot, gap, or groove. For example, each of the passengers 36 may represent a passenger view perspective of the passenger vehicle 30, and the configuration of the boom coaster 10 may generally block the tracks 12, 14 and/or the leg member 28 from the passenger view perspective. Additionally, manufacturing the simulated ride surface 16 may be simplified by utilizing the leg member 28 that extends around the simulated ride surface 16 because the slot, gap, or groove, may not be formed in the simulated ride surface 16. This configuration also provides a more immersive environment because passengers will not observe the slot, gap, or groove in the upcoming simulated ride surface 16 as they travel along the ride path.

It should be noted that while the leg member 28 is illustrated as being coupled to the first lateral side 34 of the passenger vehicle 30, the leg member may be coupled to any side or surface of the passenger vehicle 30. For example, in other embodiments (see, e.g., FIG. 20), the leg member 28 may extend around the simulated ride surface 16 and be coupled to a bottom side 37 (e.g., surface) of the passenger vehicle 30. In still further embodiments, the leg member 28 may extend around the simulated ride surface 16 and be coupled to any suitable surface of the passenger vehicle 30. As discussed above, the leg member 28 may be detachable from the passenger vehicle 30, and thus, configured to couple to the passenger vehicle 30 at multiple locations (e.g., the leg member is not permanently fixed to a surface of the passenger vehicle 30). Additionally, the leg member 28 may be configured to move to different locations of the passenger vehicle 30 via a slot or groove depending on movement of the passenger vehicle (e.g., the leg member 28 may move along a slot or groove of the passenger vehicle 30 as a result of movement of the passenger vehicle 30).

In some embodiments, the tracks 12, 14 are overhead of the passenger vehicle 30 and the leg member 28 would extend downward to the passenger vehicle past the simulated ride surface 16 (e.g., a faux environmental piece or faux track). Further, in embodiments that will be discussed in further detail below, the orientation of the leg member 28 relative to the passenger vehicle 30 may change throughout a ride depending on the position of the passenger vehicle 30 along a ride path. For example, as the passenger vehicle 30 approaches a downturn along the ride path, the orientation of the tracks 12, 14 relative to the passenger vehicle 30 may change and the connection between the leg member 28 and the passenger vehicle 30 may allow for rotation (e.g., pendulous movement) such that the leg member 28 extends to engagement with the passenger vehicle 30 from behind the passenger vehicle 30 during the downturn of the ride path.

The passenger experience may be further enhanced by including features that may conceal the leg member 28. Concealing the leg member 28 may add to the passenger's perception that the path of passenger vehicle 30 is directed, or otherwise impacted, by the simulated ride surface 16. For example, the leg member 28 may be painted a certain color (e.g., black) that blends in with other features of the ride environment. As another example, the leg member 28 may be hidden from a passenger's view via a blocking component included on the passenger vehicle 30 (e.g., if the passenger vehicle were themed as a plane, a wing of the plane may substantially hide the leg member 28).

The passenger vehicle 30 may be coupled to the leg member 28 such that the passenger vehicle 30 is suspended a distance 38 above the simulated ride surface 16. For example, in certain embodiments, the distance 38 may be between 1 inch and 3 feet, between 0.5 inches and 1 foot, or between 0.1 and 6 inches. Moreover, the distance 38 between the passenger vehicle 30 and the simulated ride surface 16 may vary throughout the course of the boom coaster 10. For example, the passenger vehicle 30 may be closer to the simulated ride surface 16 at a loading/unloading zone of the boom coaster 10 such that a prospective passenger (e.g., someone waiting in line) may perceive the passenger vehicle 30 as being directed along the simulated ride surface 16 (e.g., the simulated ride surface 16 dictates movement and/or a path of the passenger vehicle 30) as it approaches the loading/unloading zone. The closer the passenger vehicle 10 is to the simulated ride surface 16, the more likely that the passenger 36, or a prospective passenger, may believe that the path of the passenger vehicle 16 is directed by the simulated ride surface 16. Additionally, the passenger vehicle 30 may include wheels 40 that spin upon contact with the simulated ride surface 16, thereby enhancing a perception that a path of the passenger vehicle 30 is indeed directed by, or otherwise impacted by, the simulated ride surface 16. The wheels 40 may also be configured to spin via a separate driving mechanism (e.g., an on board motor 41 or magnets) or as a result of movement of the passenger vehicle 30 (e.g., air moving through a pinwheel causing it to spin). In such embodiments, the passenger vehicle 30 may be positioned slightly above the simulated ride surface 16, thereby enabling the wheels 40 to spin without contacting the simulated ride surface 16. In other embodiments, the distance 38 may be the same throughout the boom coaster 10.

The simulated ride surface 16 may be any surface or object configured to block the tracks 12, 14, the carrier 26, and/or the leg member 28 from the passenger view perspective, while creating a perception that a path of the passenger vehicle 30 is directed by, or otherwise impacted by, the simulated ride surface 16. FIG. 2 illustrates a perspective view of the boom coaster 10 of FIG. 1, where the simulated ride surface 16 is a flat surface. In the illustrated embodiment of FIG. 2, the simulated ride surface 16 is a flat surface having an upper face 42 and a lower face 44, opposite the upper face 42. The upper and lower faces 42, 44 may be substantially parallel to a direction 46 of movement of the passenger vehicle 30 along the tracks 12, 14. It should be noted that while the passengers 36 are illustrated as facing a first direction 48, the passenger vehicle may be configured to move in a second direction 49, opposite the first direction 48, such that the passengers 36 are facing backwards to the movement. In certain embodiments, the upper face 42 and/or the lower face 44 may include drawings, paintings, pictures, protrusions, gaps, rifts, ramps, or any other feature that may enhance the passenger's visual experience and/or perception that the simulated ride surface 16 directs, or otherwise impacts or influences, the path of the passenger vehicle 30. In other embodiments, the boom coaster 10 may not include a simulated ride surface 16. Embodiments of the simulated ride surface 16 are described in more detail herein with reference to FIGS. 7-16.

As shown in the illustrated embodiment of FIG. 2, the upper track 12 and the lower track 14 may be connected by a plurality of support members 50. The support members 50 may enhance a structural integrity of the boom coaster 10, for example. In certain embodiments, the plurality of support members 50 may have the same height, such that the distance between the upper track 12 and the lower track 14 remains constant throughout a length of the tracks 12, 14. Moreover, the bogies 18 and 22 may be coupled by an interconnecting component 52, such that the bogies 18 and 22 remain a constant distance between one another. In certain embodiments, the distance between the upper track 12 and the lower track 14 corresponds to the distance between the bogies 18 and 22. Additionally, FIG. 2 illustrates the upper track 12 having a third bogie 54 and the lower track 14 having a fourth bogie 56. In the illustrated embodiment, the third and fourth bogies 54 and 56 are coupled by a second interconnecting component. Moreover, the interconnecting component 52 and the second interconnecting component may be coupled via the carrier 26.

FIG. 2 also illustrates that the passenger vehicle 30 may include more than two wheels 40 (e.g., the passenger vehicle 30 of FIG. 2 has four wheels 40) as well as transport more than two passengers 36 (e.g., the passenger vehicle 30 of FIG. 2 transports 4 passengers 36). In other embodiments, the passenger vehicle 30 may have less than two wheels (e.g., 1 or none), or the passenger vehicle 30 may have more than two wheels (e.g., 3, 4, 5, 6, 7, 8, 9, 10, or more). Additionally, the passenger vehicle 30 may transport less than two passengers 36 (e.g., 1), or the passenger vehicle 30 may transport more than two passengers (e.g., 3, 4, 5, 6, 7, 8, 9, 10, or more) along the length of the tracks 12 and 14. Although the tracks 12 and 14 illustrated in FIGS. 1 and 2 are in the vertical configuration, the boom coaster 10 may use tracks with other configurations (e.g., horizontal).

Figure 3:
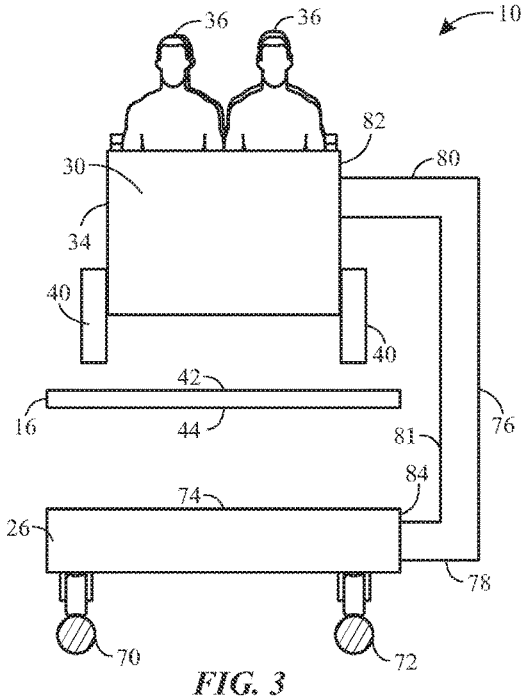
FIG. 3 is a sectional view of an embodiment of the boom coaster of FIG. 1 that includes a horizontal track, in accordance with an aspect of the present disclosure.

FIG. 3 is a sectional view of the boom coaster 10 with tracks 70, 72 positioned in a side-by-side (e.g., horizontal) arrangement. Therefore, a face 74 of the carrier 26 may be substantially parallel to the upper face 42 and the lower face 44 of the simulated ride surface 16. In certain embodiments, the carrier 26 may be wider than the simulated ride surface 16 such that the carrier 26 includes an increased center of gravity to support a weight of the passenger vehicle 30 (e.g., the passenger vehicle 30 itself and the passenger 36). In other embodiments, the carrier 26 may be narrower than the passenger vehicle 30 to facilitate hiding the carrier 26 from the passenger 36. In such embodiments, the carrier 26 may be constructed from relatively heavy materials to increase the center of gravity of the carrier 26. In other embodiments having a narrow carrier, weights may be attached to the carrier 26 to enhance the center of gravity of the carrier 26. In other embodiments, the carrier 26 and/or the bogies 18 and 22, may include wheels (e.g., the wheels 20, 24) on multiple sides of the tracks 70, 72, thereby securing (e.g., clamping) the carrier 26 to the tracks 70, 72 so that it may bear the weight of the passenger vehicle 30. It should be understood that the carrier 26 may include any suitable width, weight, or clamping engagement combination, such that the carrier 26 has an appropriate center of gravity to safely and securely support the weight of the passenger vehicle 30 and the passenger 36.

In certain embodiments, the boom coaster 10 may include a leg member 76 with a first curved portion 78, a second curved portion 80, and a straight portion 81 (e.g., a bracket shape or C-shape) to couple the carrier 26 to the passenger vehicle 30. However, it should be noted that the leg member 76 may include any other suitable configuration (e.g., a J-shape or an L-shape). As shown, the leg member 76 is coupled to a second lateral side 82 of the passenger vehicle 30. The first curved portion 78 and the second curved portion 80 may enable the first track 70 and the second track 72 to be completely hidden beneath the simulated ride surface 16 (e.g., the first curved portion 78 extends underneath the simulated ride surface 16). As discussed previously, the curved portions 78, 80 may enable the leg member 76 to extend around the simulated ride surface 16, thereby eliminating the need for any gaps, grooves, or holes in the simulated ride surface 16 for the leg member 76 to pass through. In other embodiments, the leg member 76 may include only the second curved portion 80 and be coupled to a side 84 of the carrier 26, such that the first curved portion 78 is not included and the leg member 76 is substantially parallel to the side 84 of the carrier 26.

Figure 4:
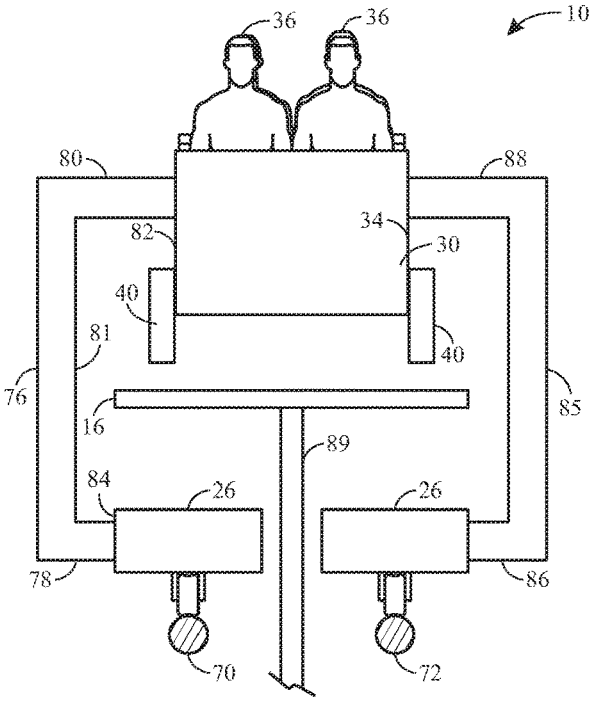
FIG. 4 is a sectional view of an embodiment of the boom coaster of FIG. 1 that includes two leg members attached to the passenger vehicle, in accordance with an aspect of the present disclosure.

FIG. 4 is a sectional view of the boom coaster 10 of FIG. 3 having a second leg member 85 coupled to the first lateral side 34 of the passenger vehicle 30 in addition to the leg member 76 coupled to the second lateral side 82 of the passenger vehicle 30. The first and second leg members 76, 84 may be coupled to the passenger vehicle 30 via a weld or any other suitable coupling technique. Additionally, the second leg member 84 may include a third curved portion 86 and a fourth curved portion 88 to enable the carrier 26 to be fully hidden from view of the passenger 36 (e.g., the third curved portion 86 extends underneath the simulated ride surface 16). Having the leg member 76 and the second leg member 84 may increase a load capacity (e.g., weight) of the boom coaster 10 such that the passenger vehicle 30 may be suitable to transport an increased number of passengers. For example, the leg members 76, 84 may each bear a substantially equal portion of the weight of the passenger vehicle 30, such that the carrier 26 may support an increased weight of the passenger vehicle 30. It should be noted that while the carrier 26 and tracks of FIG. 4 are shown in the horizontal configuration, the carrier 26 and the tracks 12, 14 positioned in the vertical configuration (e.g., shown in FIGS. 1 and 2) may also be used in embodiments of the boom coaster 10 having more than one leg member.

In certain embodiments, a beam 89 may be employed to support the simulated ride surface 16. The beam 89 may be positioned between the track 70 and the track 72. Therefore, the carrier 26 may be divided into two different portions (e.g., one portion coupled to the track 70 and the other portion coupled to the track 72). Accordingly, the two portions may be configured to move along the tracks 70, 72 at the same speed so that the two portions remain substantially aligned with respect to the passenger vehicle 30.

Figure 5:
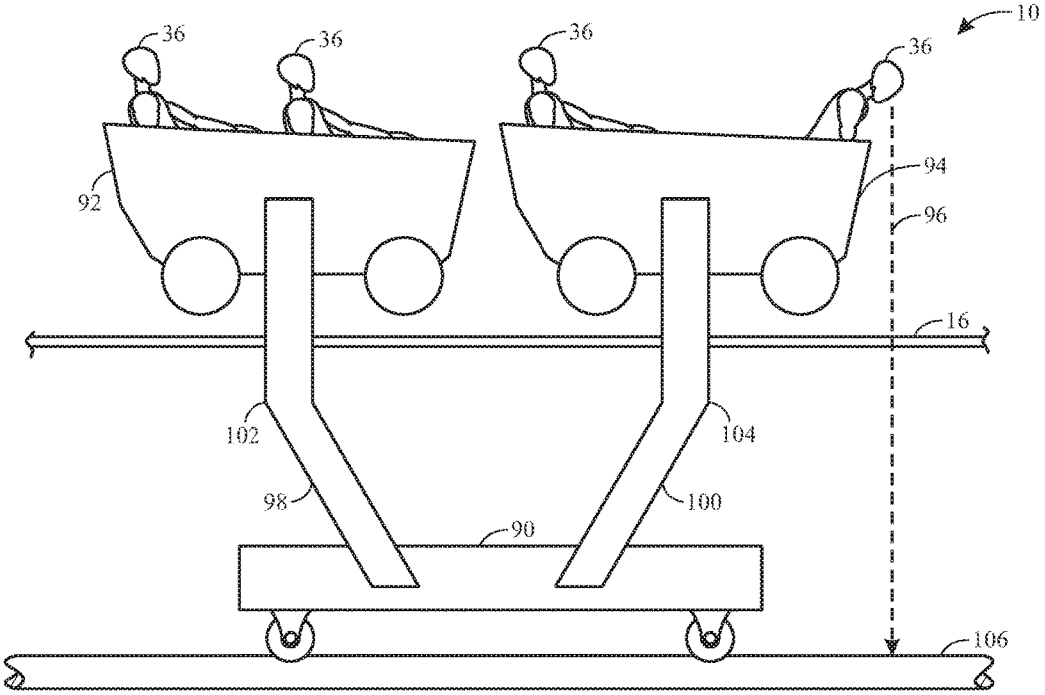
FIG. 5 is an elevation view of an embodiment of the boom coaster of FIG. 1 that includes two leg members coupled to separate passenger vehicles, in accordance with an aspect of the present disclosure.

FIG. 5 illustrates a side view of the boom coaster 10 that includes a single carrier 90 for a first passenger vehicle 92 and a second passenger vehicle 94. Accordingly, the carrier 90 may be easily hidden from a viewpoint 96 of the passenger 36 because the carrier 90 may be positioned between the first passenger vehicle 92 and the second passenger vehicle 94, such that no portion of the carrier 90 extends into the viewpoint 96 of the passenger 36. Therefore, when the simulated ride surface 16 includes openings such as breaks, gaps, or the like, the passenger 36 may be prevented from seeing the carrier 90 through the opening.

The illustrated embodiment of FIG. 5 shows a first leg member 98 coupling the carrier 90 to the first passenger vehicle 92 and a second leg member 100 coupling the carrier 90 to the second passenger vehicle 94. The first leg member 98, as illustrated, includes a bend portion 102 that may enhance a load capacity (e.g., weight) of the first leg member 98. Similarly, the second leg member 100 may also include a bend portion 104. In other embodiments, the first leg member 98 and the second leg member 100 may not include the bend portions 102 and 104, respectively, but may be substantially perpendicular to a track 106.

As mentioned previously, the first leg member 98 and the second leg member 100 may include curved portions (e.g., the first curved portion 78 and the second curved portion 80 of FIG. 3) that enable the first leg member 98 to couple the carrier 90 to the first passenger vehicle 92 and the second leg member 100 to couple the carrier 90 to the second passenger vehicle 94 without creating a gap, groove, or hole in the simulated ride surface 16. These curved portions may be desirable because they eliminate the need for the gap, groove, or hole in the simulated ride surface 16, and thus, eliminate the potential for the passenger 36 to see the track 106 and/or the carrier 90 through such openings. Additionally, manufacture of the simulated ride surface 16 may be facilitated because no gap, groove, or hole is formed in the simulated ride surface 16.

Figure 6:
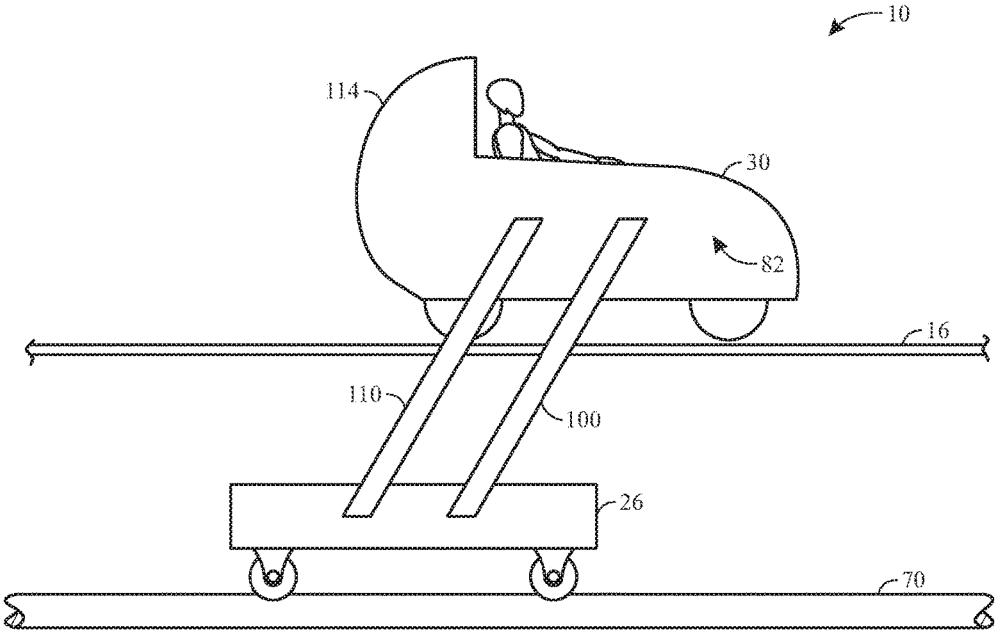
FIG. 6 is an elevational side view of an embodiment of the boom coaster of FIG. 1 that includes two leg members coupled to a surface of the passenger vehicle, in accordance with an aspect of the present disclosure.

FIG. 6 is a side view of the boom coaster 10 having both a first leg member 110 and a second leg member 112 coupled to the second lateral side 82 of the passenger vehicle 30. Accordingly, the load capacity of the boom coaster 10 may increase because the weight of the passenger vehicle 30 is distributed amongst more leg members (e.g., the first leg member 110 and the second leg member 112 rather than a single leg member). Any suitable number of leg members may couple the carrier 26 to the first lateral side 34 and/or the second lateral side 82 of the passenger vehicle 30 while still hiding the carrier 26 and the tracks 70, 72 from the passenger 36.

FIG. 6 illustrates the passenger vehicle 30 offset from (e.g., positioned in front of) the carrier 26. Accordingly, the passenger 36 may not be able to see the carrier 26 when looking over the sides 34, 82 of the passenger vehicle 30. Moreover, when the simulated ride surface 16 includes openings (e.g., gaps, holes, or rifts that, for example, simulate jumps or flying), the passenger 36 may not see the carrier 26 through an upcoming opening because the carrier 26 is positioned behind the passenger 36. Additionally, the passenger vehicle 30 may include a back portion 114 that may be configured to create an additional barrier to the viewpoint of the passenger 36. It should be noted that the passenger vehicle 30 may include any configuration (e.g., any suitable number of protrusions, barriers, or blocking devices) that is suitable to block the passenger 36 from viewing the carrier 26, the tracks 70, 72, and/or the leg members 110, 112, while still providing an enhanced ride experience. The carrier 26, the tracks 70, 72, and/or the leg members 110, 112 may also be concealed from the passenger 36 by utilizing a dark environment (e.g., a room or building with few lights) in a surrounding setting of the boom coaster 10. For example, the passenger 36 may not be able to see the carrier 26, the tracks 70, 72, and/or the leg members 110, 112 because of the dark environment.

As mentioned previously, the passenger vehicle 30 itself may also include blocking components that hide the carrier 26, the tracks 70, 72, and/or the leg members 110, 112 from the passenger 36. In addition to including components configured to hide the carrier 26, the tracks 70, 72, and/or the leg members 110, 112, the passenger vehicle 30 may be shaped in accordance with an overall theme of the boom coaster. For example, the passenger vehicle 30 may be a train, a boat, a plane, a car, or any other device that may be consistent with a theme of the boom coaster 10. The simulated ride surface 16 may also be consistent with the overall theme of the boom coaster 10. Therefore, the simulated ride surface 16 may include a variety of configurations to enhance the passenger's 36 ride experience.

Figure 7:
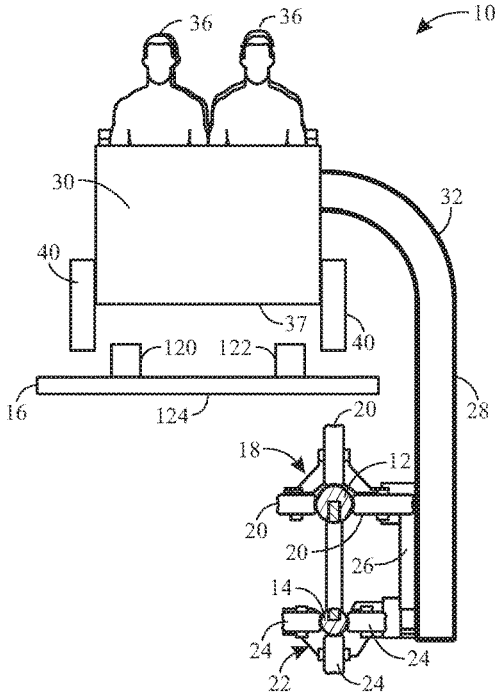
FIG. 7 is a sectional view of an embodiment of the boom coaster of FIG. 1, in which a simulated ride surface includes rails and a tie, in accordance with an aspect of the present disclosure.

FIG. 7 is a sectional view of the boom coaster 10 having a simulated ride surface 16 that includes a first rail 120, a second rail 122, and a tie 124. Accordingly, the simulated ride surface 16 may be configured to imitate a roller coaster track (e.g., to further enhance the perception that the path of the passenger vehicle 30 is controlled by the simulated ride surface 16). In other embodiments, the simulated ride surface 16 may be imitating a railway track (e.g., when the passenger vehicle 30 imitates a train). Additionally, although the illustrated embodiment of FIG. 7 includes the upper track 12 and the lower track 14 in the vertical configuration, the first rail 120, the second rail 122, and the tie 124 may be utilized with the horizontal configuration of the tracks 70 and 72.

Figure 8:
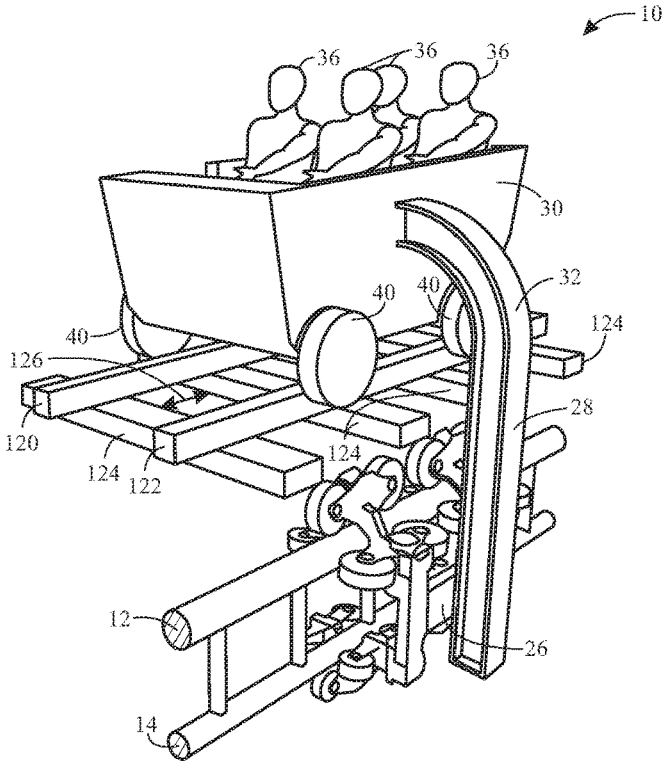
FIG. 8 is a perspective view of the boom coaster of FIG. 7, in accordance with an aspect of the present disclosure.

FIG. 8 is a perspective view of the boom coaster 10 with the simulated ride surface 16 of FIG. 7. The embodiment of FIG. 8 illustrates a plurality of ties 124 coupled to the first rail 120 and the second rail 122. In certain embodiments, the ties 124 may be spaced such that gaps 126 are formed between each of the plurality of ties 124. For example, the gaps 126 may provide a perception that the simulated ride surface 16 is a roller coaster track or a railway track. In such embodiments, the wheels 40 of the passenger vehicle 30 may be aligned with the first rail 120 and the second rail 122, such that the wheels 40 are configured to spin on contact with the first and second rails 120 and 122. In other embodiments, the ties 124 may be spaced such that no gaps are created. In the embodiments without the gaps 126, the wheels 40 of the passenger vehicle 30 may be configured to spin upon contact with the ties 124 and/or the rails 120, 122.

Figure 9:
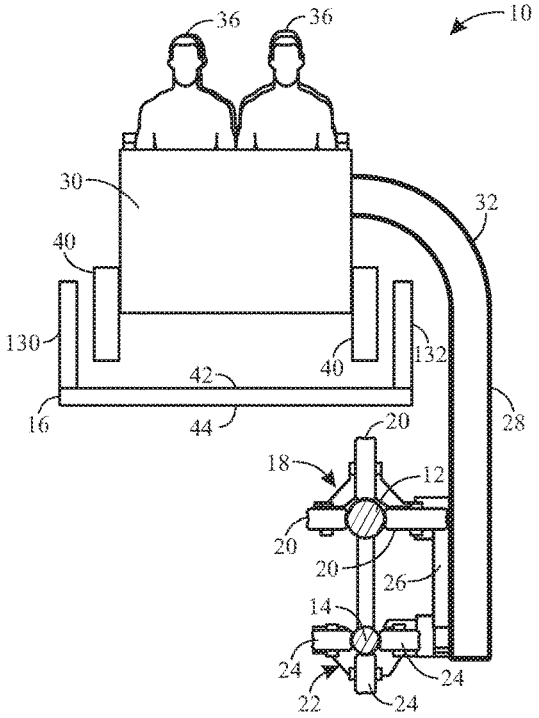
FIG. 9 is a sectional view of an embodiment of the boom coaster of FIG. 1, in which a the simulated ride surface includes a trough configuration, in accordance with an aspect of the present disclosure.

FIG. 9 is a sectional view of the boom coaster 10 having a simulated ride surface 16 that includes a trough configuration. Therefore, the simulated ride surface 16 includes a first barrier 130 and a second barrier 132 in addition to the upper face 42 and the lower face 44. The trough configuration of the simulated ride surface 16 may be desirable when the simulated ride surface 16 includes water (e.g., when the passenger vehicle 30 is themed as a boat or other transportation device configured to float). Accordingly, the first and second barriers 130, 132 may be configured to hold water so that the simulated ride surface 16 may convey the water as if it were flowing in a stream or river, for example. The passenger vehicle 30 of FIG. 9 is illustrated as having the wheels 40, however, no wheels may be included (e.g., when the passenger vehicle imitates a boat).

Figure 10:
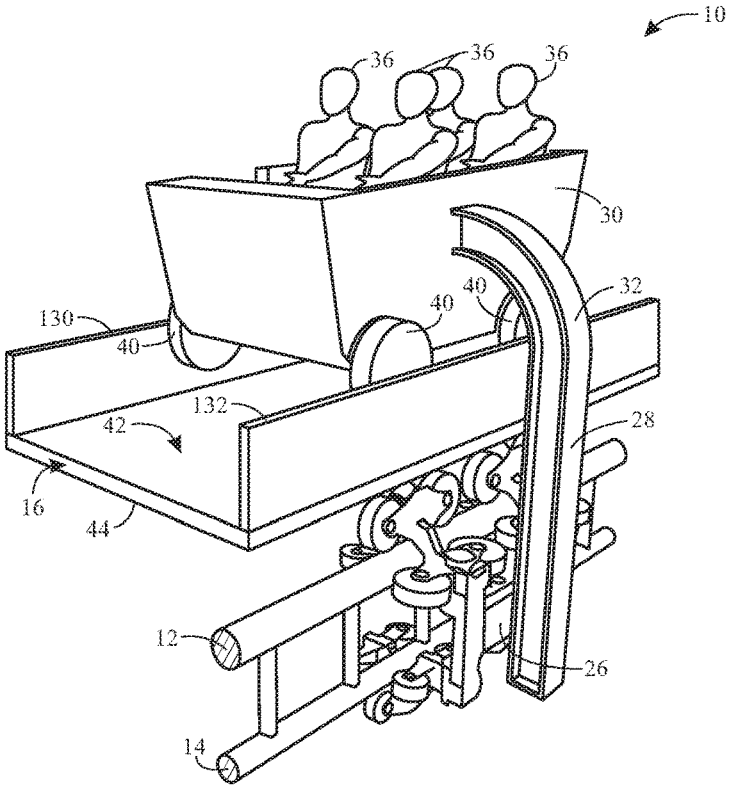
FIG. 10 is a perspective view of the boom coaster of FIG. 9, in accordance with an aspect of the present disclosure.

FIG. 10 is a perspective view of the boom coaster 10 having the simulated ride surface 16 of FIG. 9 (e.g., the trough configuration having the first and second barriers 130, 132). Although the illustrated embodiments of FIGS. 9 and 10 include the upper track 12 and the lower track 14 in the vertical configuration, the trough configuration of the simulated ride surface 16 may be utilized with the horizontal configuration of the tracks 70 and 72. For example, in some embodiments, the tracks 70, 72 may be disposed within the trough (e.g., inside of the barriers 130, 132 and facing the upper face 42). In such embodiments, jets or other devices configured to convey water may be utilized to direct water over the tracks 70, 72. Accordingly, rather than the simulated ride surface 16 blocking the tracks 70, 72 from the view of the passengers 36, the water flowing over the tracks 70, 72 may act to conceal the tracks 70, 72.

Figure 11:
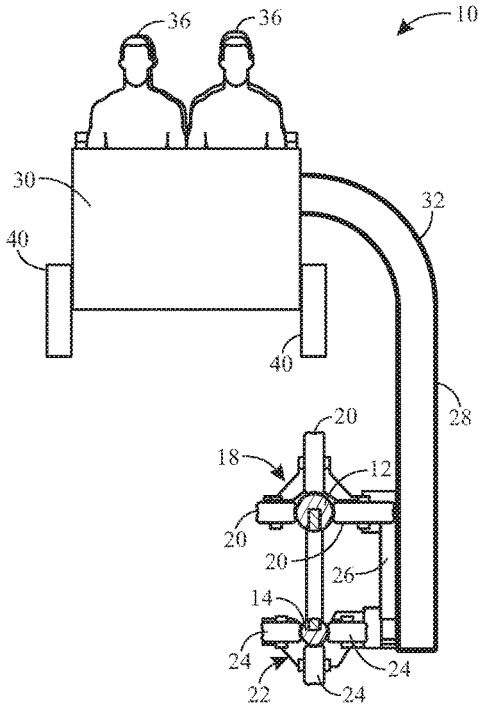
FIG. 11 is a sectional view of an embodiment of the boom coaster of FIG. 1 that includes no simulated ride surface, in accordance with an aspect of the present disclosure.
Figure 12:
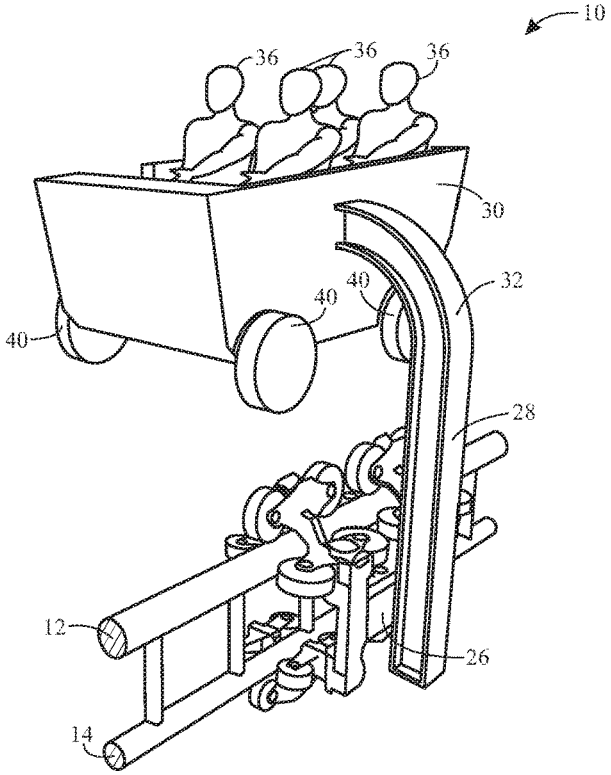
FIG. 12 is a perspective view of the boom coaster of FIG. 11, in accordance with an aspect of the present disclosure.

FIG. 11 is a sectional view of the boom coaster 10 having no simulated ride surface 16. The passenger vehicle 30 of FIG. 11 is illustrated as having the wheels 40, however, no wheels may be included. The absence of the simulated ride surface 16 may create a perception to the passenger 36 that the passenger vehicle 30 is floating or otherwise suspended above (e.g., jumping over) another surface (e.g., the ground). Accordingly, the tracks 12 and 14 may be disposed substantially beneath the passenger vehicle 30 such that the tracks 12 and 14 are hidden from the viewpoint of the passenger 36. The illustrated embodiment of FIG. 11 may be desirable when the boom coaster 10 is constructed in a dark environment, such that the passenger 36 may not easily perceive the tracks 12 and 14 in front of, or behind, the passenger vehicle 30. Additionally, FIG. 12 shows a perspective view of the boom coaster 10 having no simulated ride surface 16. Although the illustrated embodiments of FIGS. 11 and 12 include the upper track 12 and the lower track 14 in the vertical configuration, embodiments of the boom coaster 10 having no simulated ride surface 10 may be used with the horizontal configuration of the tracks 70 and 72.

A similar effect to that achieved in FIGS. 11 and 12 may be performed by lowering the simulated ride surface 16 relative to the passenger vehicle 30 along the ride path. For example, the simulated ride surface 16 may slope downwards from the passenger vehicle 30 towards the tracks 12, 14, thereby creating a perception that the passenger vehicle is floating or otherwise suspended above the simulated ride surface 16, while still hiding the carrier 26 and/or the tracks 12, 14 from the passenger 36. In other words, the simulated ride surface 16 is still between the passenger vehicle 30 and the tracks 12, 14, but it is simply a greater distance from the passenger vehicle 30 to create a floating effect. In certain embodiments, the simulated ride surface 16 may be painted (e.g., decorated) to blend in with the surrounding settings such that the passenger believes that the simulated ride surface 16 disappeared. In actuality, however, the simulated ride surface 16 may still be beneath the passenger vehicle hiding the tracks 12, 14 and/or the carrier 26. It should be noted that different heights of the leg member 28 may facilitate a wider range of distances that may be created between the simulated ride surface 16 and the passenger vehicle. For example, the larger the height of the leg member 28, the more enjoyment the passenger 36 may experience because of the thrill created by the perception that the passenger vehicle 36 is further from the simulated ride surface 16.

Figure 13:
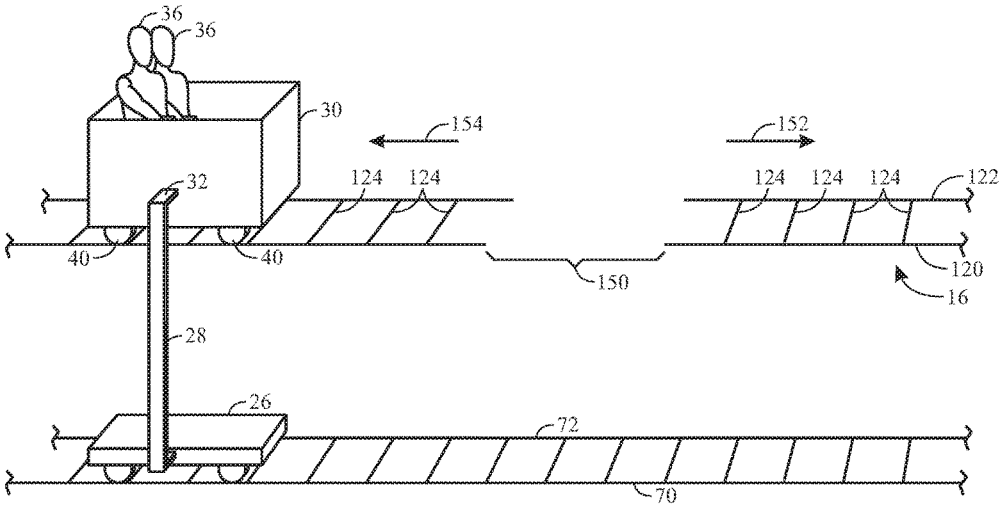
FIG. 13 is a perspective view of an embodiment of the boom coaster of FIG. 1, in which a simulated ride surface includes a gap, in accordance with an embodiment of the present disclosure.

FIG. 13 is a perspective view of the tracks 70 and 72 and the simulated ride surface 16 (e.g., having the first rail 120, the second rail 122, and the plurality of ties 124) that includes a gap 150 (e.g., a jump, a hole, a break, or an opening). Because the passenger 36 may believe that the simulated ride surface 16 controls a path of the passenger vehicle 30, the passenger 36 may fear or anticipate that the passenger vehicle 30 may crash or otherwise incur damage as a result of the gap 150. Accordingly, the boom coaster 10 may be configured to provide an increased thrill to the passenger 36 by creating such fear or anticipation. Moreover, the passenger 36 may feel a sense of relief or excitement when the passenger vehicle 30 safely clears the gap 150. It should be noted that the passenger vehicle 30 may travel in either a direction 152 or a direction 154 when moving across the gap 150. Although the illustrated embodiment of FIG. 13 includes the tracks 70 and 72 in the horizontal configuration, the gap 150 may also be included in embodiments using the upper track 12 and the lower track 14 (e.g., the vertical configuration).

Figure 14:
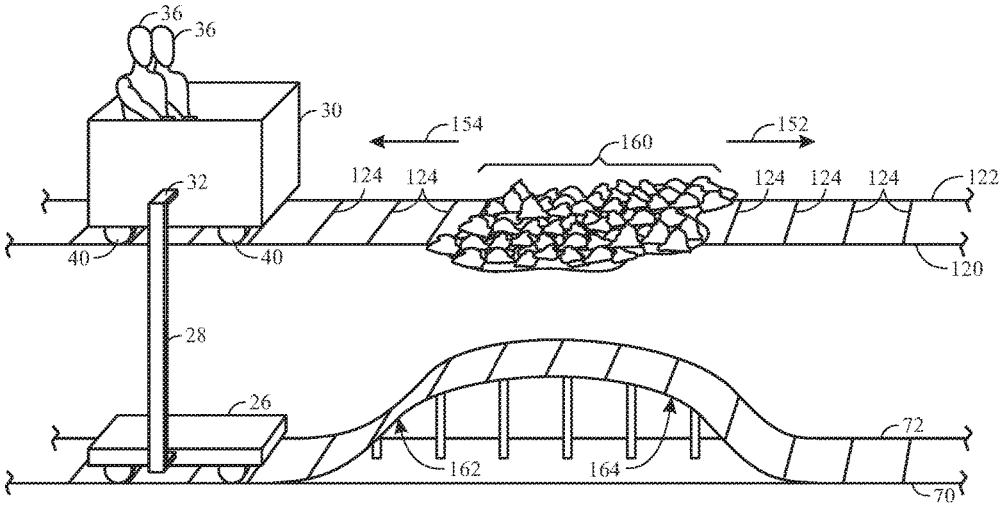
FIG. 14 is a perspective view of an embodiment of the boom coaster of FIG. 1, in which a simulated ride surface includes an obstruction, in accordance with an embodiment of the present disclosure.

Similarly, FIG. 14 is a perspective view of the tracks 70 and 72 and the simulated ride surface 16 (e.g., having the first rail 120, the second rail 122, and the plurality of ties 124) that includes an obstruction 160 (e.g., a puddle of water, a pile of rocks) or other form of debris in the path of the passenger vehicle. Therefore, because the passenger 36 may believe that the simulated ride surface 16 controls a path of the passenger vehicle 30, the passenger 36 may fear or anticipate that the passenger vehicle 30 may crash or otherwise incur damage as a result of the obstruction 160. Accordingly, the boom coaster 10 may be configured to provide an increased thrill to the passenger 36 by creating such fear or anticipation. Moreover, the passenger 36 may feel a sense of relief or excitement when the passenger vehicle 30 safely clears the obstruction 160.

As shown in FIG. 14, the tracks 70 and 72 may include a first sloped portion 162 and a second sloped portion 164 so that the passenger vehicle 30 may safely ascend over the obstruction 160 and subsequently descend back towards the simulated ride surface 16 (e.g., to create a jumping effect). In other embodiments, the obstruction 160 may not inhibit the path of the passenger vehicle 30, but only appear to the passenger 36 as debris that the passenger vehicle 30 may run over. In such embodiments, the upward sloping portion 162 and the downward sloping portion 164 may not be included. It should be noted that the passenger vehicle 30 may travel in either the direction 152 or the direction 154 when moving across the obstruction 160. Although the illustrated embodiment of FIG. 14 includes the tracks 70 and 72 in the horizontal configuration, the obstruction 160 may also be included in embodiments with the upper track 12 and the lower track 14 (e.g., the vertical configuration).

Figure 15:
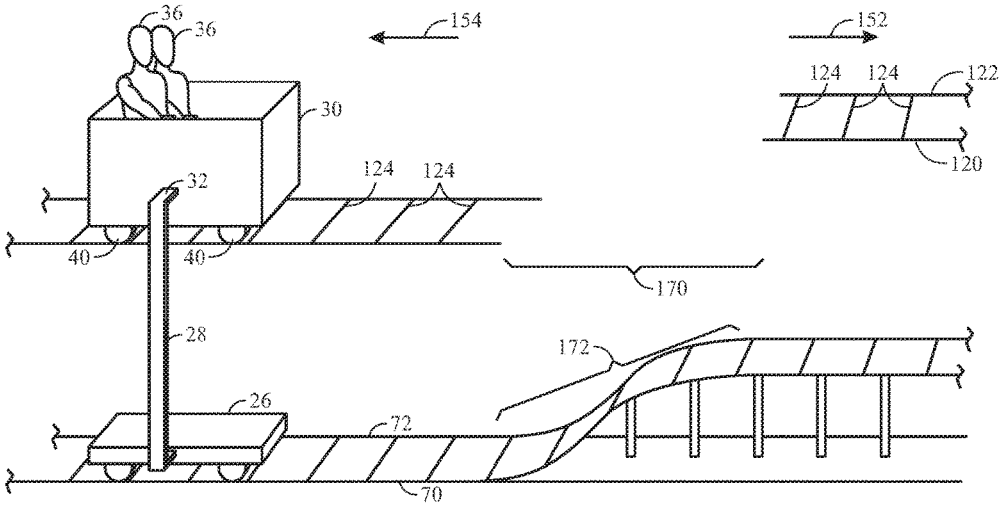
FIG. 15 is a perspective view of an embodiment of the boom coaster of FIG. 1, in which a simulated ride surface includes a jump, in accordance with an embodiment of the present disclosure.

FIG. 15 is a perspective view of the tracks 70 and 72 and the simulated ride surface 16 (e.g., having the first rail 120, the second rail 122, and the plurality of ties 124) that includes an elevated gap 170 (e.g., a jump, an elevated opening) in the path of the passenger vehicle. Because the passenger 36 may believe that the simulated ride surface 16 controls a path of the passenger vehicle 30, the passenger 36 may fear or anticipate that the passenger vehicle 30 may crash or otherwise incur damage as a result of the elevated gap 170. Accordingly, the boom coaster 10 may be configured to provide an increased thrill to the passenger 36 by creating such fear or anticipation. Moreover, the passenger 36 may feel a sense of relief or excitement when the passenger vehicle 30 safely clears the elevated gap 170. As shown in FIG. 15, the tracks 70 and 72 may include a sloping portion 172 so that the passenger vehicle 30 may safely ascend/descend across the elevated gap 170. It should be noted that the passenger vehicle 30 may travel in either the direction 152 or the direction 154 when moving across the elevated gap 170. Although the illustrated embodiment of FIG. 15 includes the tracks 70 and 72 in the horizontal configuration, the elevated gap 170 may also be included in embodiments with the upper track 12 and the lower track 14 (e.g., the vertical configuration).

Figure 16:
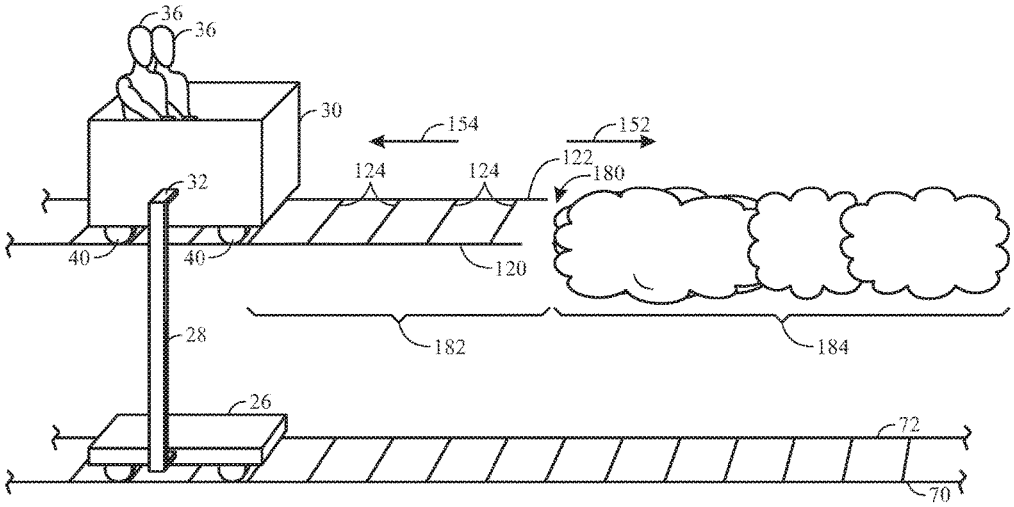
FIG. 16 is a perspective view of an embodiment of the boom coaster of FIG. 1, in which a simulated ride surface includes a transition between a first surface to a second surface, in accordance with an embodiment of the present disclosure.

FIG. 16 is a perspective view of the tracks 70 and 72 and the simulated ride surface 16 including a surface transition 180 between a first surface 182 (e.g., the simulated ride surface 16 with the first rail 120, the second rail 122, and the plurality of ties 124) and a second surface 184 (e.g., clouds, or any surface consistent with a theme of the boom coaster 10). Because the passenger 36 may believe that the simulated ride surface 16 controls a path of the passenger vehicle 30, the passenger 36 may fear or anticipate that the passenger vehicle 30 may not be suitable to travel on the second surface 184 (e.g., clouds, water, grass, sky). Accordingly, the boom coaster 10 may be configured to provide an increased thrill to the passenger 36 by creating such fear or anticipation. Moreover, the passenger 36 may feel a sense of relief or excitement when the passenger vehicle 30 safely travels on the second surface 184. As discussed above, the passenger vehicle 30 may be configured to travel in either the direction 152 or the direction 154. Although the illustrated embodiment of FIG. 16 includes the tracks 70 and 72 in the horizontal configuration, the surface transition 180 may also be included in embodiments with the upper track 12 and the lower track 14 (e.g., the vertical configuration).

Figure 17:
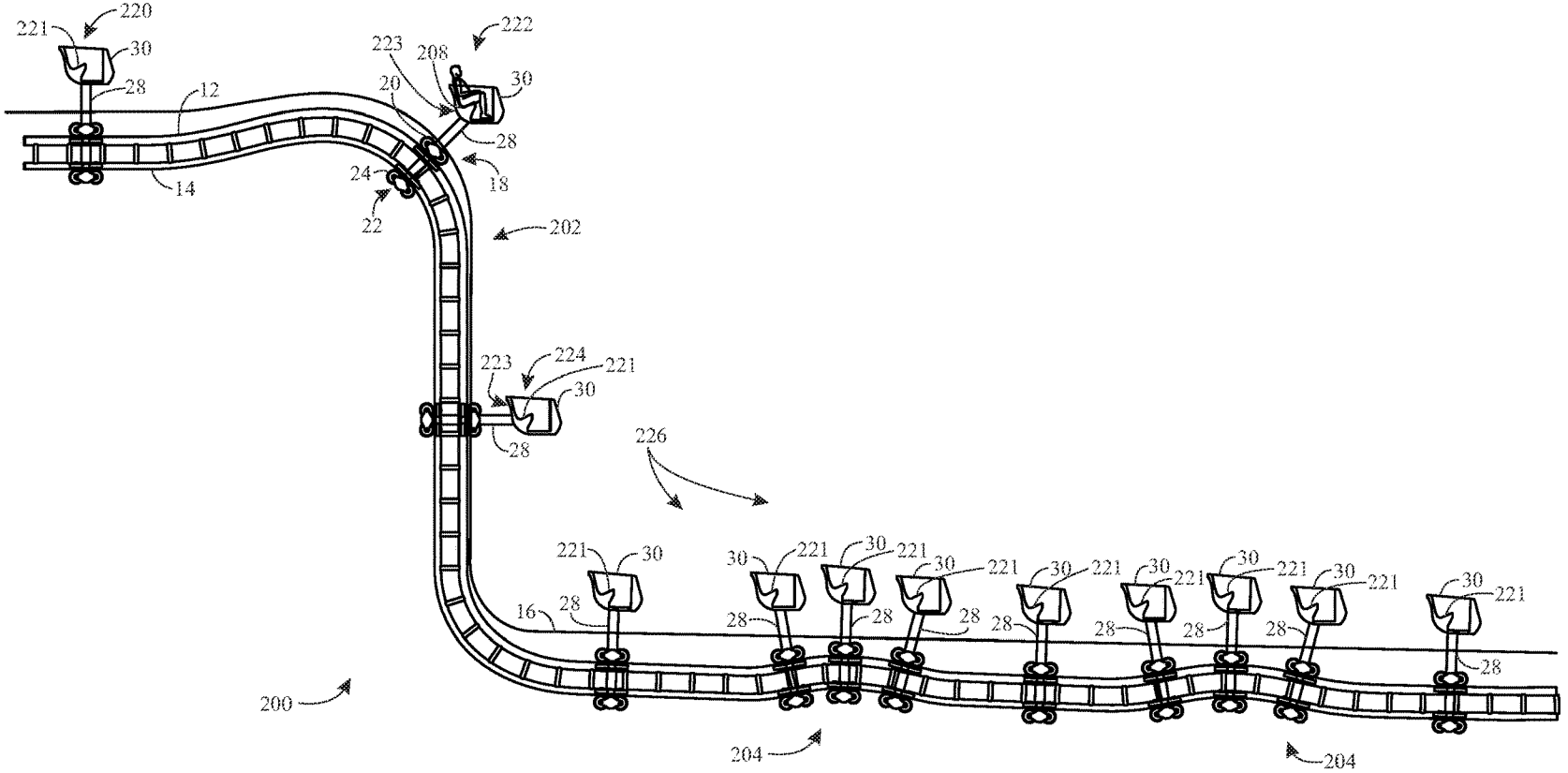
FIG. 17 is a side view of an embodiment of a ride in which a boom coaster proceeds on a ride path that includes a substantially vertical drop and various hops or bumps, in accordance with an aspect of the present disclosure.

FIG. 17 is a side view of the boom coaster 10 proceeding on a ride path 200 that includes the tracks 12, 14 arranged to provide a substantially vertical drop 202 and various hops or bumps 204. As will be appreciated, the ride path 200 may include any number of different twists, turns, drops, bumps, and so forth. The illustrated drop 202 and bumps 204 are examples to facilitate explanation of certain operational features of the boom coaster 10. For example, FIG. 17 illustrates various orientations of the passenger vehicle 30 with respect to the tracks 12, 14 and the leg member 28 as the passenger vehicle 30 progresses along the ride path 200 and encounters different configurations of the tracks 12, 14. Further, while present embodiments include both gravity-based and powered configurations, FIG. 17 illustrates a powered configuration wherein the boom coaster 10 is capable of controlling descents and so forth. For example, when the passenger vehicle 30 is traversing the drop 202, it may be operated in a controlled descent by any of various mechanisms for such controlled operation.

Specifically, FIG. 17 illustrates operational results of a rotational joint 208 that couples the leg member 28 to the passenger vehicle 30 (e.g., a pivot attachment) and adds a degree of rotational freedom. The rotational joint 208 provides an ability to pivot where the leg member 28 connects to the passenger vehicle 30 such that the passenger vehicle 30 remains upright without regard to the track orientation. That is, the rotational joint 208 functions to essentially keep the passenger vehicle 30 level during transitions along the ride path 200. For example, in an initial position 220 (e.g., a loading configuration) of the illustrated embodiment, the leg member 28 is substantially vertical and extends essentially directly downward from the passenger vehicle 30 such that it can be described as extending under the passenger vehicle 30 to the tracks 12, 14. However, as the tracks 12, 14 transition to the drop 202, the rotational joint 208 allows the leg member 28 and the passenger vehicle 30 to change their orientation with respect to one another. Based on one or more of various techniques (e.g., controlled actuation or load balancing of the passenger vehicle 30), the passenger vehicle 30 may be arranged such that a seating surface 221 of the passenger vehicle maintains a substantially level orientation with respect to the Earth (e.g., transverse to gravity) by rotating with respect to the leg member 28. Accordingly, when the passenger vehicle 30 transitions into the drop 202 (position 222), the ride vehicle 30 stays essentially level relative to the Earth but the leg member 30 transitions to being underneath and toward a rear 223 of the ride vehicle 30. Similarly, when the passenger vehicle 30 is in the middle of the drop 202 (position 224), the leg member 28 is essentially directly behind the passenger vehicle 30.

Other positions 226 of the passenger vehicle 30 and leg member 28 are also shown to illustrate that changes in the ride path 200 can cause a wide variety of orientation changes. As an example, in some embodiments, the ride path 200 may turn abruptly upward and cause the leg member 28 to rotate relative to the passenger vehicle 30 such that it is directly in front of the passenger vehicle 30. It should be noted that the rotational joint 208 may include any of various mechanisms for facilitating such rotation. Further, the rotational joint 208 may include a braking mechanism, stabilization features (e.g., resistance features that slow rotation and prevent sway), actuation features that communicate with and facilitate control from an automation controller (e.g., a programmable logic controller), additional articulation mechanisms that facilitate motion other than rotation, and so forth. In some embodiments, the rotational joint 208 may be positioned at a center of gravity of the passenger vehicle 30. In other embodiments, the rotational joint 208 may be positioned offset from the center of gravity of the passenger vehicle 30. In such embodiments where the rotational joint 208 is offset from the center of gravity, a motor (see, e.g., FIGS. 18 and 19) may be included to adjust the rotational joint 208 and maintain the passenger vehicle at a substantially level orientation with respect to the Earth. In still further embodiments, the rotational joint 208 may be configured to change positions with respect to the passenger vehicle 30 by moving along a groove or slot of the passenger vehicle 30.

Figure 18:
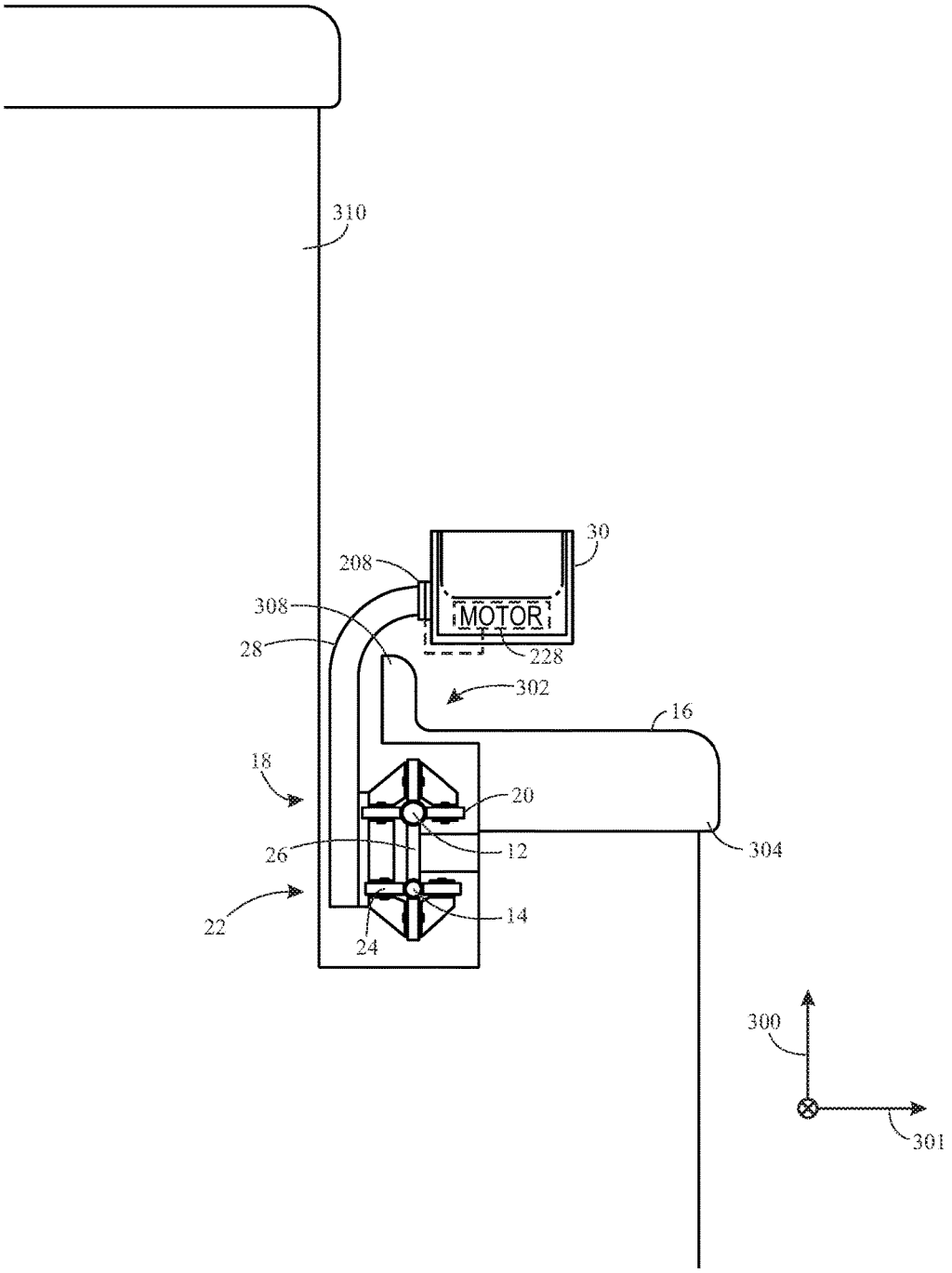
FIG. 18 is a sectional view of an embodiment of a boom coaster, illustrating tracks located at least partially underneath a passenger vehicle, in accordance with an aspect of the present disclosure.
Figure 19:
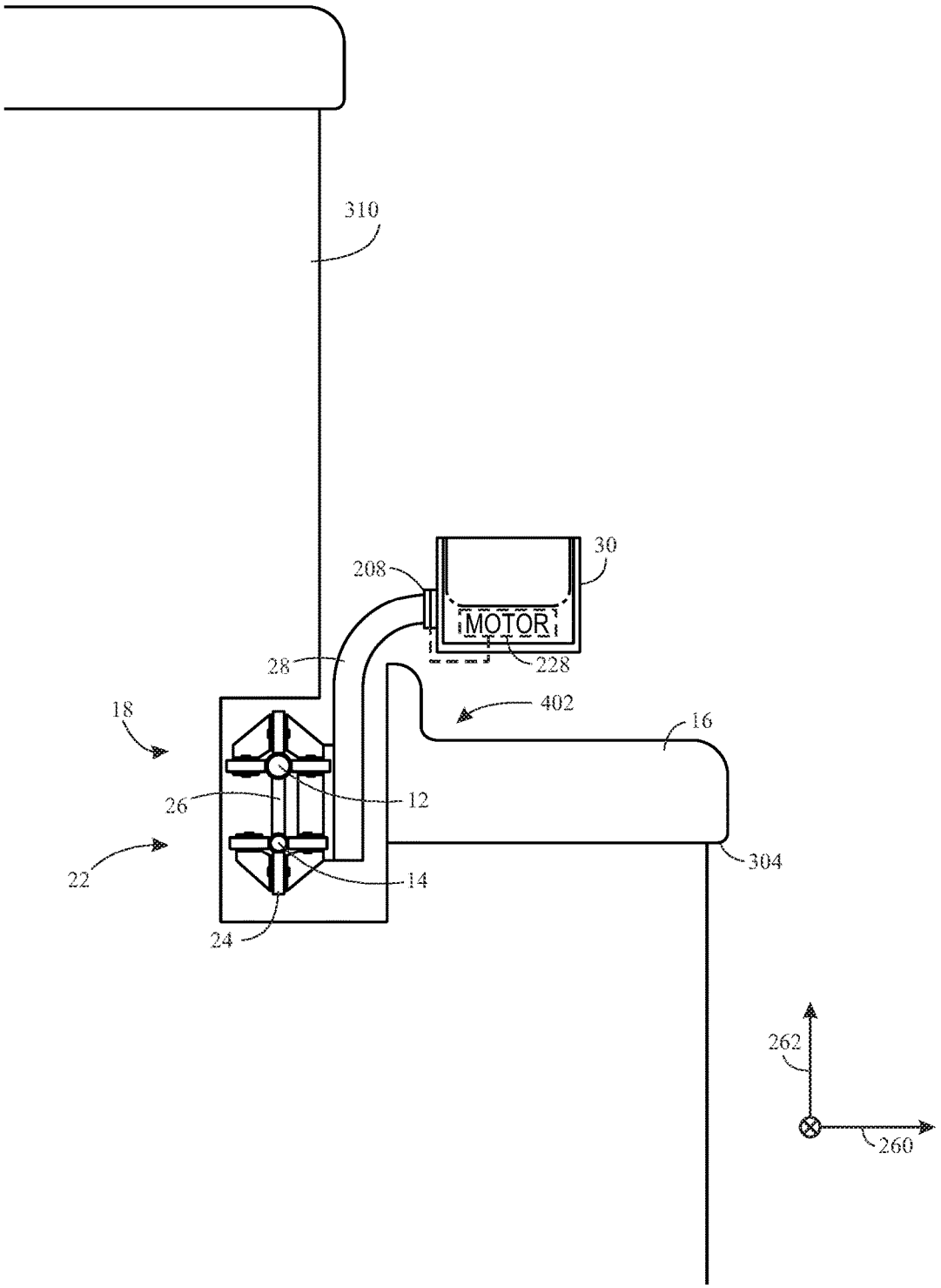
FIG. 19 is a sectional view of an embodiment of a boom coaster, illustrating tracks located below and to a side of a passenger vehicle, in accordance with an aspect of the present disclosure.

In some embodiments, the rotational joint 208 may also enable the passenger vehicle 30 to pivot (e.g., swivel) about the leg member 28. For example, the passenger vehicle may rotate about the leg member 28 via the rotational joint 208 (e.g., driven by an on-board motor 228), thereby providing the boom coaster 10 with another degree of freedom. FIGS. 18 and 19 illustrate examples of such configurations.

In particular, FIG. 18 is a sectional view of the boom coaster 10 that illustrates an embodiment wherein the tracks 12, 14 are located at least partially underneath the passenger vehicle 30. However, in different positions along the ride path 200, the tracks 12, 14 may be in different positions relative to the passenger vehicle 30 (e.g., behind or in front of the passenger vehicle 30) due to the rotation about the rotational joint 208 discussed above. Accordingly, the arrangement illustrated in FIG. 18 may be referred to as having the tracks 12, 14 and the passenger vehicle 30 in alignment along an axis (e.g., axis 300) that is transverse to a rotational axis 301 (the axis about which rotation occurs) of the rotational joint 208, which may be transverse to the direction of gravity. In the illustrated embodiment of FIG. 18, the simulated ride surface 16 is located between the tracks 12, 14 and the passenger vehicle 30 along the axis 300. A portion 302 of the simulated ride surface 16 is cantilevered over the tracks 12, 14 from a main body 304 of the simulated ride surface to block viewing of the tracks 12, 14 and other system components. In the illustrated embodiment, the simulated ride surface 16 also includes an upturned piece 308 to further block viewing. It should be noted that, in the embodiment illustrated by FIG. 18, there is also a scenic backdrop 310 that facilitates concealment of the leg member 28. For example, the scenic backdrop 310 and the leg member 28 may be painted flat black or some other color and texture to blend in with each other (or provides something to view to distract the riders from looking down toward the leg member 28).

FIG. 19 is a sectional view of the boom coaster 10 that illustrates an embodiment wherein the tracks 12, 14 are located below and to a side of the passenger vehicle 30. However, in different positions along the ride path 200, the tracks 12, 14 may be in different positions relative to the passenger vehicle 30 (e.g., to the side and also behind or in front of the passenger vehicle 30) due to the rotation about the rotational joint 208 discussed above. Accordingly, the arrangement illustrated in FIG. 19 may be referred to as having the tracks 12, 14 and the passenger vehicle 30 offset relative to one another along the axis (e.g., axis 300) that is transverse to the rotational axis 301 of the rotational joint 208. In the illustrated embodiment of FIG. 19, the simulated ride surface 16 is positioned to the side (a lateral side) of the tracks 12, 14 along the axis 301. A portion 402 of the simulated ride surface 16 is upturned to block viewing. In the embodiment illustrated by FIG. 19, the scenic backdrop 310 extends over the tracks 12, 14 to facilitate concealment of the tracks 12, 14 and related system components. Generally, there is a housing within the backdrop 310 for the tracks 12, 14 and related system components. As set forth above, the scenic backdrop 310 and the leg member 28 may be painted flat black or some other color and texture to blend in with each other. The particular color used may also account for lighting conditions present throughout the ride. It should be noted that the embodiment shown in FIG. 19, wherein the tracks 12, 14 are offset relative to axis 300, may facilitate shortening of the leg member 28 relative to the embodiment shown in FIG. 18 because the tracks 12, 14 can be positioned closer to the passenger vehicle 30 and because the simulated ride surface 16 is not sandwiched between the tracks 12, 14 and the passenger vehicle 30.

FIG. 20 is a sectional view of the boom coaster 10, illustrating the leg member 28 coupled to the bottom surface 37 of the passenger vehicle 30. As shown in the illustrated embodiment of FIG. 20, the leg member 28 may include a coupling member 410 (e.g., coupling the leg member 28 to the passenger vehicle 30), a first horizontal member 412, a first vertical member 414, a second horizontal member 416, and/or a second vertical member 418. The coupling member 410, the first horizontal member 412, the first vertical member 414, the second horizontal member 416, and/or the second vertical member 418 may enable the leg member 28 to include a configuration that wraps around the simulated ride surface 16 (e.g., overlaps at least a portion of three sides of the simulated ride surface 16) and couples to the bottom surface of the passenger vehicle 30. Accordingly, the leg member 28 may be substantially blocked from the view of the passengers 36. The second horizontal member 416 and the second vertical member 418 may enable the tracks 12, 14 to be positioned underneath the simulated ride surface 16 at a point 420 that is substantially at the center of the simulated ride surface 16. As such, the tracks 12, 14 may be further blocked from the view of the passengers 36. However, the point 420 of attachment may be located off-center in other embodiments.

As discussed above, it may be beneficial to configure the passenger vehicle 30 with additional degrees of freedom to provide enhanced enjoyment to the passengers 36 of the boom coaster 10. For example, FIG. 21 is a sectional view of the boom coaster 10, illustrating the leg member 28 coupled to the passenger vehicle 30 via a pivot joint 440. In certain embodiments, the pivot joint 440 may enable the passenger vehicle 30 to rotate in a first direction 442 and/or a second direction 444 about an axis 446 (e.g., a longitudinal axis of the passenger vehicle 30). Accordingly, the boom coaster 10 may provide the effect of the passenger vehicle 30 making a sharp curve and/or traveling over an uneven surface. As shown in the illustrated embodiment of FIG. 21, the simulated ride surface 16 is substantially parallel with the bottom surface 37 of the passenger vehicle 30 while the passenger vehicle 30 is tilted, thereby creating the effect that the ride path of the passenger vehicle 30 is controlled by the simulated ride surface 16. However, in other embodiments, the simulated ride surface 16 may not be parallel to the bottom surface 37 of the passenger vehicle, thereby creating the effect that the passenger vehicle 30 is moving on one of the wheels 40.

In certain embodiments, the passenger vehicle 30 may rotate in the first direction 442 and/or the second direction 444 by passively actuating the pivot joint 440 (e.g., using an gravitational forces and the weight of the passenger vehicle 30), thereby rotating the passenger vehicle 30 about the axis 446. In other embodiments, the pivot joint 440 may be positioned offset from a center of gravity of the passenger vehicle 30. Accordingly, rotation of the passenger vehicle 30 may be actively controlled using an on-board motor 448, for example, to rotate the passenger vehicle 30 about the axis 446 as the passenger vehicle 30 moves along the ride path. In such scenarios, the additional degree of freedom provided by the pivot joint 440 may provide enhanced amusement to the passengers 36, thereby potentially encouraging the passengers 36 to ride the boom coaster 10 multiple times.

While only certain features of the present disclosure have been illustrated and described herein, many modifications and changes will occur to those skilled in the art. It is, therefore, to be understood that the appended claims are intended to cover all such modifications and changes as fall within the true spirit of the present disclosure. While certain disclosed embodiments have been disclosed in the context of amusement or theme parks, it should be understood that certain embodiments may also relate to other uses. Further, it should be understood that certain elements of the disclosed embodiments may be combined or exchanged with one another.

The invention claimed is:

1. A boom coaster, comprising:

a passenger vehicle;

a track;

a bogie coupled to the passenger vehicle and the track and configured to move along the track; and a simulated ride surface positioned above the track and beneath the passenger vehicle;

wherein the simulated ride surface is configured to imitate a path of the passenger vehicle, the bogie is coupled to a surface of the passenger vehicle via a leg member extending around the simulated ride surface, the leg member is coupled to the surface of the passenger vehicle via a rotational joint positioned at a center of gravity of the passenger vehicle, the rotational joint is configured to maintain a position of the passenger vehicle with respect to Earth as the passenger vehicle moves along various changes in the track, and the leg member suspends the passenger vehicle above the simulated ride surface such that the bogie and the track are blocked from a passenger view perspective of the passenger vehicle.

2. The boom coaster of claim 1, wherein the simulated ride surface is substantially flat region including a face disposed substantially parallel to a direction of movement of the passenger vehicle.

3. The boom coaster of claim 1, wherein the simulated ride surface comprises a trough configuration.

4. The boom coaster of claim 1, wherein the simulated ride surface comprises a gap, an elevated gap, an obstruction, or a surface transition.

5. The boom coaster of claim 1, comprising a carrier coupled to the bogie and the leg member.

6. The boom coaster of claim 1, comprising an additional passenger vehicle and an additional leg member, wherein the additional leg member extends around the simulated ride surface to couple the bogie to an additional surface of the additional passenger vehicle.

7. The boom coaster of claim 1, wherein the passenger vehicle comprises a wheel configured to spin when in contact with the simulated ride surface, to spin when the passenger vehicle moves along the ride path, or both.

8. The boom coaster of claim 1, wherein the passenger vehicle comprises a wheel that does not engage the simulated ride surface and is configured to spin via a motor.

9. A boom coaster, comprising:

a passenger vehicle;

a track;

a bogie coupled to the passenger vehicle and the track and configured to move along the track;

a simulated ride surface extending along a ride path defined by the track such that the simulated ride surface remains between the passenger vehicle and the track as the passenger vehicle moves along all or portions of the ride path;

a leg member extending around the simulated ride surface and coupling the bogie to the passenger vehicle to enable the passenger vehicle to move along the ride path; and a rotational joint positioned at a center of gravity of the passenger vehicle, wherein the leg member is coupled to the passenger vehicle at the rotational joint, and the rotational joint is configured to maintain a position of the passenger vehicle with respect to Earth as the passenger vehicle moves along various changes in the track.

10. The boom coaster of claim 9, wherein the track is offset from the passenger vehicle along an axis transverse to a rotational axis of the rotational joint.

11. The boom coaster of claim 9, wherein the various changes in the track comprise a drop, a bump, or both.

12. A boom coaster, comprising:

a passenger vehicle;

a first track disposed below the passenger vehicle;

a first bogie coupled to the first track and configured to move along the first track;

a second track disposed below the passenger vehicle;

a second bogie coupled to the second track and configured to move along the second track;

a carrier coupled to the first bogie and the second bogie, wherein the carrier is configured to be directed along a ride path by the first bogie and the second bogie;

a simulated ride surface extending along a ride path defined by the first and second tracks such that the simulated ride surface remains between the passenger vehicle and the first and second tracks as the passenger vehicle moves along portions of the ride path; and a leg member coupled to the carrier and the passenger vehicle, wherein the leg member is configured to extend around the simulated ride surface and couple to a surface of the passenger vehicle, wherein the leg member is coupled to the passenger vehicle via a rotational joint positioned at a center of gravity of the passenger vehicle and the rotational joint is configured to maintain a position of the passenger vehicle with respect to Earth as the passenger vehicle moves along various changes in the first track, the second track, or both.

13. The boom coaster of claim 12, wherein the leg member is a substantially "J"-shaped boom.

* * * * *